US011541323B2

(12) United States Patent
Yates

(10) Patent No.: US 11,541,323 B2
(45) Date of Patent: Jan. 3, 2023

(54) LEARNING-BASED SYSTEM COMPRISING STACKABLE BUILDING BLOCKS

(71) Applicant: WILDFLOWER LEARNING TOOLS, LLC., Trenton, NJ (US)

(72) Inventor: Margaret Yates, West Orange, NJ (US)

(73) Assignee: WILDFLOWER LEARNING TOOLS, LLC., Trenton, NJ (US)

( * ) Notice: Subject to any disclaimer, the term of this patent is extended or adjusted under 35 U.S.C. 154(b) by 0 days.

(21) Appl. No.: 17/191,927

(22) Filed: Mar. 4, 2021

(65) Prior Publication Data

US 2021/0291070 A1 Sep. 23, 2021

Related U.S. Application Data

(60) Provisional application No. 62/990,811, filed on Mar. 17, 2020.

(51) Int. Cl.
*A63H 33/08* (2006.01)

(52) U.S. Cl.
CPC ..... *A63H 33/086* (2013.01)

(58) Field of Classification Search
CPC ..... A63H 33/086; A63H 33/04; A63H 33/08; A63H 33/084
USPC ..... 446/124–128, 85
See application file for complete search history.

(56) References Cited

U.S. PATENT DOCUMENTS 1,400,066 A * 12/1921 Huck ..... A63H 33/107 446/123
2,406,759 A * 9/1946 Glukes ..... A63H 33/065 446/127
3,597,874 A * 8/1971 Ogsbury ..... A63H 33/065 446/104
3,632,147 A * 1/1972 Finger ..... A47F 5/14 403/171
3,651,597 A * 3/1972 Daenen ..... A63H 33/086 446/124
3,822,499 A * 7/1974 De Vos ..... A63H 33/108 446/121

(Continued)

FOREIGN PATENT DOCUMENTS

DE 202017006419 U1 * 1/2018 ..... A63H 33/08
KR 20130002471 U * 4/2013 ..... A63H 33/08

OTHER PUBLICATIONS

Meinbaukasten GMBH, DE 202017006419 U1 machine translation, uploaded Oct. 5, 2021, Espacenet, 21 pages.*

(Continued)

*Primary Examiner* — Eugene L Kim
*Assistant Examiner* — Matthew B Stanczak
(74) *Attorney, Agent, or Firm* — Gearhart Law LLC; David Postolski

(57) ABSTRACT

A learning-based building block system is described. The learning-based building block system comprises at least two stackable blocks. The at least two stackable blocks may include: a first stackable block having a cube configuration, a second stackable building block having a sprocket configuration, a third stackable building block having a half-pipe configuration, and a fourth stackable building block having a table configuration. The configuration of each of the first, the second, the third, and the fourth stackable block is unique.

5 Claims, 16 Drawing Sheets

(56) References Cited

U.S. PATENT DOCUMENTS 3,921,360 A * 11/1975 Baldwin ..... E04B 1/1906 52/655.2
D257,366 S * 10/1980 Gabriel ..... D21/502
4,438,615 A * 3/1984 Wendel ..... E04B 1/1906 403/171
5,112,263 A * 5/1992 Penillard ..... A63H 33/042 446/89
5,265,395 A * 11/1993 Lalvani ..... B44C 3/123 403/176
5,318,470 A * 6/1994 Denny ..... A63H 33/10 446/126
5,460,561 A * 10/1995 Dahlgren ..... A63H 33/04 446/103
5,599,221 A * 2/1997 Gabriel ..... A63H 33/10 446/124
6,109,997 A * 8/2000 Hatting ..... A63H 33/062 446/103
6,443,798 B1 * 9/2002 Perry ..... A63H 33/08 446/112
6,561,866 B1 * 5/2003 Lee ..... A63H 33/042 446/103
6,641,453 B1 * 11/2003 Morales ..... A63H 33/04 273/157 R
6,672,931 B1 * 1/2004 Bagley ..... A63H 33/08 446/106
6,702,640 B1 * 3/2004 Park ..... A63H 33/04 446/105
6,840,699 B2 * 1/2005 Rogers ..... F16B 7/044 403/171
7,063,481 B2 * 6/2006 Trull ..... A01G 9/16 403/170
7,255,624 B2 * 8/2007 Daftari ..... A63H 33/046 446/485
7,371,146 B2 * 5/2008 Scarborough ..... A63H 33/062 446/108
7,374,468 B2 * 5/2008 Flodin ..... A63H 17/002 446/102
D692,507 S * 10/2013 Meys ..... D21/502
9,155,976 B1 * 10/2015 Mosquera ..... A63H 33/082
D744,599 S * 12/2015 Gan ..... D21/504
9,883,739 B1 * 2/2018 Chiles ..... A47B 13/088
2002/0086605 A1 * 7/2002 Cheung ..... A63H 33/062 446/124
2005/0245167 A1 * 11/2005 Sinisi ..... A63H 33/08 446/85
2006/0128257 A1 * 6/2006 Aggar ..... A63H 33/062 446/122
2007/0077854 A1 * 4/2007 Jeon ..... A63H 33/084 446/122
2007/0178800 A1 * 8/2007 Kim ..... A63H 33/084 446/124
2008/0220689 A1 * 9/2008 Mimlitch ..... A63H 33/108 446/91
2009/0149110 A1 * 6/2009 Scarborough ..... A63H 33/084 446/120
2009/0247045 A1 * 10/2009 Pettey ..... A63H 33/042 446/484
2010/0285718 A1 * 11/2010 Stone ..... A63H 33/108 446/124
2011/0028063 A1 * 2/2011 Colangelo ..... A63H 33/062 446/120
2013/0012098 A1 * 1/2013 Meys ..... A63H 33/101 446/85
2013/0102220 A1 * 4/2013 Wang ..... A63H 33/067 446/102
2013/0115848 A1 * 5/2013 Silverglate ..... A63H 33/04 446/124
2013/0178129 A1 * 7/2013 Habibi ..... A63H 33/04 446/91
2013/0210314 A1 * 8/2013 Rottjer ..... A63H 33/062 446/124
2013/0210315 A1 * 8/2013 Hohrmann ..... A63H 33/08 446/124
2014/0045403 A1 * 2/2014 Murphy ..... A63H 33/101 446/124
2014/0106108 A1 * 4/2014 Lin ..... A63H 33/082 428/58
2015/0321115 A1 * 11/2015 Hower ..... A63H 33/08 446/124
2017/0072331 A1 * 3/2017 Yang ..... A63H 33/04
2017/0120157 A1 * 5/2017 Ochi ..... A23G 3/50
2017/0340981 A1 * 11/2017 Iliovits ..... A63H 33/086
2018/0126294 A1 * 5/2018 Rosen ..... A63H 33/04
2018/0133614 A1 * 5/2018 Kendall ..... A63H 33/065
2019/0266920 A1 * 8/2019 Kim ..... A63H 33/106
2020/0330894 A1 * 10/2020 Ashton ..... A63H 33/086
2020/0360831 A1 * 11/2020 Haldeman ..... A63H 33/082
2021/0291070 A1 * 9/2021 Yates ..... A63H 33/086

OTHER PUBLICATIONS

Jong, KR-20130002471-U Machine Translation, uploaded Sep. 1, 2022, Espacenet, 3 pages.*

* cited by examiner

200

200

200

300

400

400

400

LEARNING-BASED SYSTEM COMPRISING STACKABLE BUILDING BLOCKS

CROSS-REFERENCE TO RELATED APPLICATIONS SECTION

This application is a U.S. Non-Provisional Patent Application that claims priority to U.S. Provisional Patent Application Ser. No. 62/990,811 filed on Mar. 17, 2020, the entire contents of which are hereby incorporated by reference in their entirety.

FIELD OF THE EMBODIMENTS

The field of the invention and its embodiments relate to a learning-based building block system comprising at least two stackable blocks each having a unique shape and configuration that allows a child to engage in play-based learning and provides an infinite number of building configurations.

BACKGROUND OF THE EMBODIMENTS

Stackable and/or interconnecting blocks are common in the toy industry. These block systems improve a child's fine motor skills. With stackable building blocks, the child can stack one or more blocks having similar or unique shapes to build limitless configurations. However, these configurations typically fall easily, as there is no direct connection between any two blocks of the system. Interconnecting blocks typically have male features that engage female features, or some other similar features, allowing the child to connect a first block to a second block. The child may interconnect any number of blocks to build a structure. However, interconnecting blocks cannot be reconfigured, rearranged, or re-oriented with respect to one another without fully disconnecting the blocks and then reconnecting the blocks in the new desired configuration. Moreover, interconnecting blocks only allow the child to connect the blocks in a quantized and finite number of ways. Additionally, stackable and interconnecting block systems fail to improve a child's gross motor skills.

Therefore, interconnecting block systems fail to easily provide reconfiguration, rearrangement, and reorientation of the blocks with respect to one another without fully disconnecting the blocks and then reconnecting the blocks in the new desired configuration. Moreover, these interconnecting block systems only allow a finite number of configurations and do not function to improve a child's gross motor skills. Thus, a need exists for an improved learning-based building block system that allows for easy reconfiguration, rearrangement, and reorientation of the blocks, while providing the child with an infinite number of building configurations.

REVIEW OF RELATED TECHNOLOGY

U.S. Pat. No. 10,343,079 B1 provides a toy building brick system. The system includes a base brick having a cubic shape such that the base brick comprises six outer walls. The base brick has an open interior and each of the outer walls comprises a female receiver such that six female receivers are formed in the base brick. In this manner, the base brick defines an all-female brick. A plurality of inserts is provided and each of the inserts is removably engaged with one of the female receivers such that an outer surface of each of the inserts faces outwardly of the open interior.

U.S. Published Patent Application No. 2019/0201805 A1 describes a building block that is reconfigurable to connect to a neighboring block by any two adjacent faces. To achieve this, the user can construct and reconfigure each individual face to provide either male or female connecting features, as well as configure slidable connections between male and female parts. The slidable connections allow two mating faces to be shifted or offset from one another in continuously varying amounts of offset.

JP 2012/165995 A describes a new health toy capable of training fingers and promoting health when playing by combining elements having different shapes.

JP 2019/030405 A describes a connected toy that can be freely combined with parts. The toy includes a leading member and an intermediate member connectable to the rear part of the leading member. At the rear part of the leading member and the intermediate member, a connection part having a protrusion protruding rearward is formed. The front portion of the intermediate member includes a pair of projecting walls that project forward and a groove formed between the pair of projecting walls and opening forward so that the intermediate member can be slidably fitted to the connecting portion.

CN 208975168 U describes a master craftsman of the Spring and Autumn period's lock. The master craftsman of the Spring and Autumn period's lock is made of six building blocks of ABCDEF, where the form and dimension of six building blocks of ABCDEF is all the same.

CN 109224477 A describes intelligent building blocks. Specifically, the reference describes modular programmable, intelligent building blocks.

CN 109045726 A describes interpolation building blocks, that includes multiple building block units, where each building block unit includes multiple sides and at least one side of the multiple sides is inclined-plane. The building blocks may also include upper bottom surface M1 or/and bottom surface M2, such that at least one side is inclined relative to the upper bottom surface M1 or/and the bottom surface M2 or horizontal plane in these sides. In some cases, upper bottom surface M1 and/or bottom surface M2 is pooled a bit, i.e., entire building blocks form conical form pointed at both ends.

CN 109011645 A describes a kind of master craftsman of the Spring and Autumn period's lock, master craftsman of the Spring and Autumn period's lock is made of six building blocks of ABCDEF, where the form and dimension of five building blocks of BCDEF is all the same. The A building block includes a first baffle, a second baffle and an interconnecting piece, where the first baffle and the second baffle are in concave character type, and four corners of first baffle and second baffle are equipped with convex block. The interconnecting piece is arranged between the first baffle and second baffle CN 108744548 A describes a kind of master craftsman of the Spring and Autumn period's lock, master craftsman of the Spring and Autumn period's lock is made of ten building blocks of ABCDEFGHIJ, where the shape size all same of nine building blocks of the BCDEFGHIJ. The B building blocks include the first block, the second block and link block, where one end of the link block is arranged on a corner of the first block and the other end of link block is arranged on a corner of the second block, such that the position of first block is corresponding with the position of the second block.

Various learning-based building block systems for children exist. However, the configuration of each component of the system, as well as the ways in which the components interact with one another, is substantially different from the present disclosure, as the other inventions fail to solve all the problems taught by the present disclosure.

SUMMARY OF THE EMBODIMENTS

The present invention and its embodiments relate to a learning-based building block system comprising at least two stackable blocks each having a unique shape and configuration that allows a child to engage in play-based learning and provides an infinite number of building configurations.

A first embodiment of the instant invention provides a building block system. The building block system comprises at least two stackable blocks. The at least two stackable blocks may include a first stackable block having a first shape, a second stackable block having a second shape, a third stackable block having a third shape, and/or a fourth stackable block having a fourth shape. The first shape, the second shape, the third shape, and the fourth shape are dissimilar.

The first shape of the first stackable block comprises a cube configuration. The cube configuration is a concavely-rounded cube configuration. The concavely-rounded cube configuration has six sides of equal dimension. Further, the concavely-rounded cube configuration comprises eight circular corners of equal dimension projecting radially from a center of the concavely-rounded cube configuration. Moreover, the concavely-rounded cube configuration comprises convex surfaces and concave surfaces matching via a ball-in-socket configuration.

The second shape of the second stackable block comprises a sprocket configuration. The sprocket configuration is an X-shaped sprocket configuration having a first side disposed opposite a second side. The X-shaped sprocket configuration comprises four radial spheres located equidistant from a center of the X-shaped sprocket configuration. The first side of each of the four radial spheres comprises a convex portion and the second side of each of the four radial spheres comprises a concave portion. Further, the second side of the center of the X-shaped sprocket configuration comprises a concave portion.

The third shape of the third stackable block comprises a half-pipe configuration. In examples, the half-pipe configuration comprises rounded corners. The fourth shape of the fourth stackable block comprises a table configuration. In examples, the table configuration is an X-shaped table configuration. The X-shaped table configuration comprises four cylindrical legs located equidistant from a center of the X-shaped table configuration. Each of the four cylindrical legs comprises a convex foot. The four cylindrical legs form an arch spanning a periphery of the X-shaped table configuration such that the arch forms a concave tabletop disposed opposite each of the convex feet.

A second embodiment of the instant invention describes a learning-based building block system. The learning-based building block system comprises a first stackable block having a cube configuration, a second stackable building block having a sprocket configuration, a third stackable building block having a half-pipe configuration, and a fourth stackable building block having a table configuration.

The cube configuration of the first stackable block is a concavely-rounded cube configuration. The concavely-rounded cube configuration comprises six sides of equal dimension, eight circular corners of equal dimension projecting radially from a center of the concavely-rounded cube configuration, convex surfaces, and concave surfaces, such that the convex surfaces match the concave surfaces via a ball-in-socket configuration.

The sprocket configuration of the second stackable block is an X-shaped sprocket configuration. The X-shaped sprocket configuration comprises a first side disposed opposite a second side and four radial spheres located equidistant from a center of the X-shaped sprocket configuration. The first side of each of the four radial spheres comprises a convex portion and the second side of each of the four radial spheres comprises a concave portion. The second side of the center of the X-shaped sprocket configuration comprises a concave portion.

The half-pipe configuration of the third stackable building block comprises rounded corners. Further, the table configuration of the fourth stackable block is an X-shaped table configuration comprising four cylindrical legs located equidistant from a center of the X-shaped table configuration. Each of the four cylindrical legs comprises a convex foot, such that the four cylindrical legs form an arch spanning a periphery of the X-shaped table configuration. The arch forms a concave tabletop disposed opposite each of the convex feet.

In general, the present invention succeeds in conferring the following benefits and objectives.

It is an object of the present invention to provide a building block system comprising at least two stackable building blocks, each having a unique shape.

It is an object of the present invention to provide a learning-based building block system comprising at least two stackable building blocks, each having a unique shape.

It is an object of the present invention to provide a learning-based building block system that allows for an infinite number of building configurations of stackable building blocks that each have a unique shape.

It is an object of the present invention to provide a learning-based building block system that engages a child's brain.

It is an object of the present invention to provide a learning-based building block system that allows a child to engage in play-based learning.

It is an object of the present invention to provide a learning-based building block system that improves a child's gross motor skills.

It is an object of the present invention to provide a learning-based building block system that improves a child's fine motor skills.

It is an object of the present invention to provide a learning-based building block system that educates a child about physics in a tangible and kinesthetic way.

DESCRIPTION OF THE PREFERRED EMBODIMENTS

Figure 1:
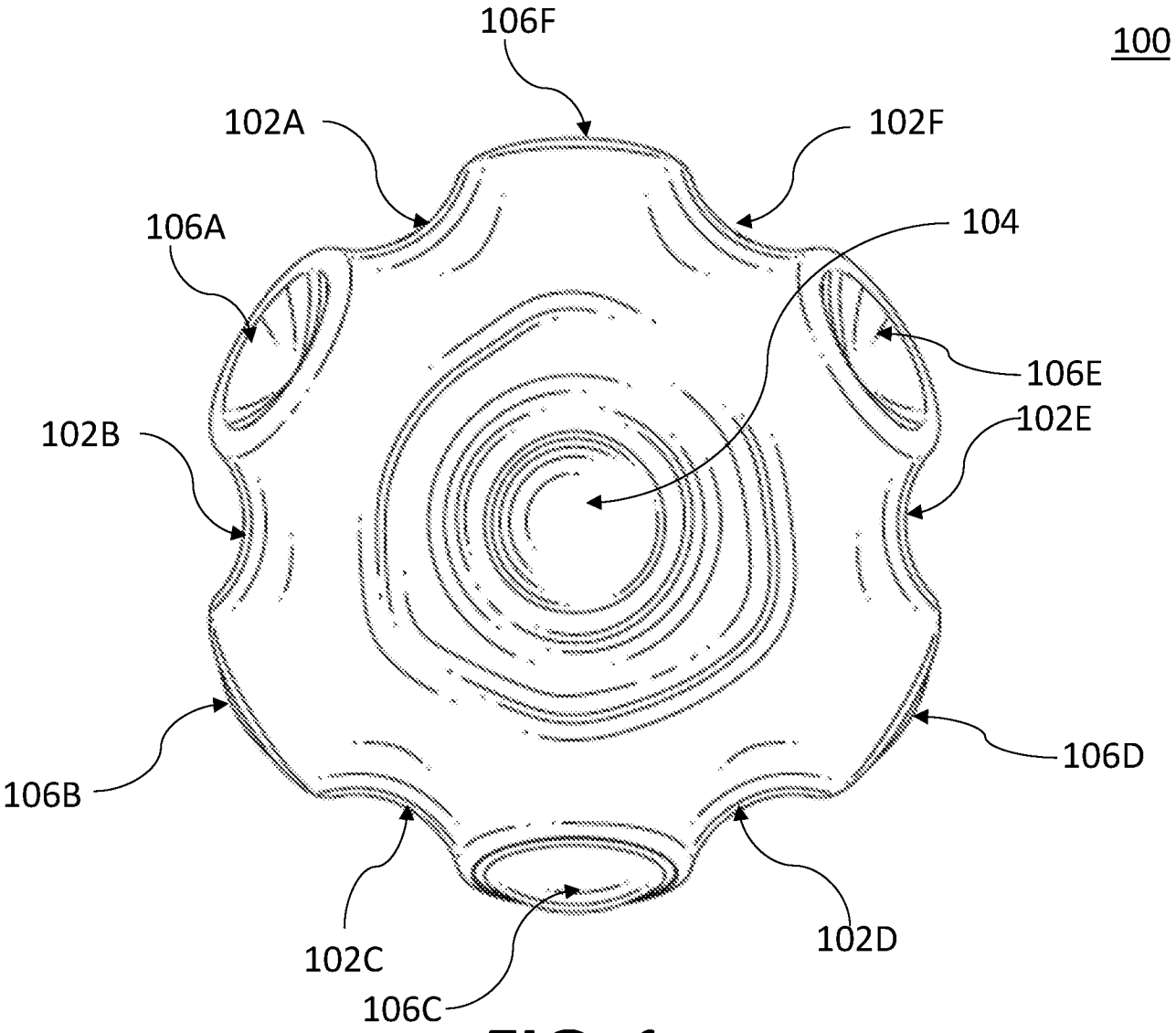
FIG. 1 depicts a three-quarters perspective view of a first embodiment of a stackable building block, in accordance with embodiments of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
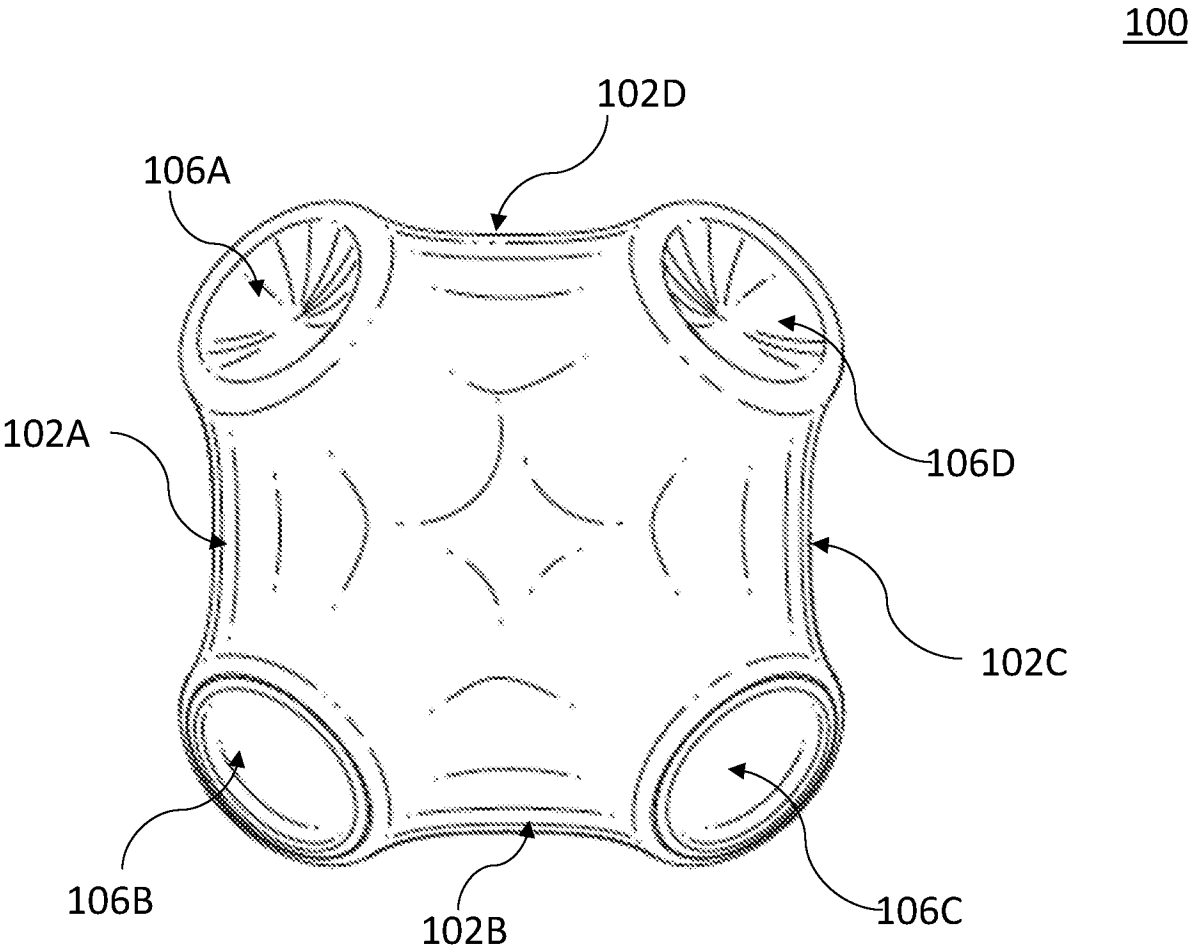
FIG. 2 depicts a front elevational view thereof of a first embodiment of a stackable building block, in accordance with embodiments of the present invention.
Figure 3:
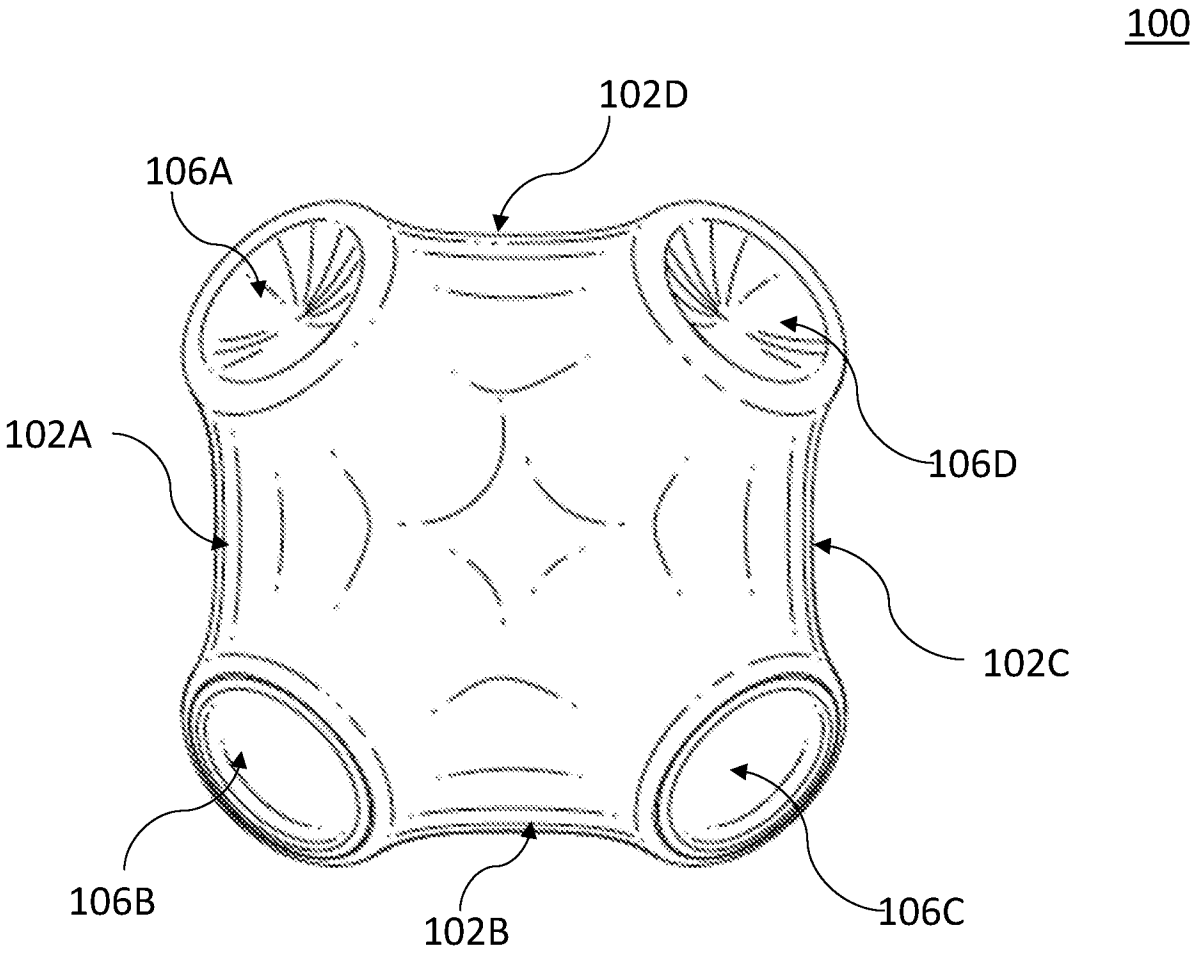
FIG. 3 depicts a rear elevational view thereof of a first embodiment of a stackable building block, in accordance with embodiments of the present invention.

FIG. 1, FIG. 2, and FIG. 3 depict perspective views of a first embodiment 100 of a stackable building block, in accordance with embodiments of the present invention.

The first embodiment 100 of the stackable building block comprises a cube configuration or shape. In examples, the cube configuration is a concavely-rounded cube configuration having six sides 102A, 102B, 102C, 102D, 102E, and 102F of equal dimension (as depicted in FIG. 1). The concavely-rounded cube configuration of the first embodiment 100 may also have eight circular corners of equal dimension projecting radially from a center 104 of the concavely-rounded cube configuration (as depicted in FIG. 1). In examples, the center 104 may be a concave surface. Further, the concavely-rounded cube configuration comprises convex surfaces and concave surfaces matching via a ball-in-socket configuration. As depicted in FIG. 1, the concave surfaces include 106A, 106E, and 106F and the convex surfaces include 106B, 106C, and 106D. As depicted in FIG. 2 and FIG. 3, the concave surfaces include 106A and 106D and the convex surfaces include 106B and 106C.

FIG. 4, FIG. 5, FIG. 6, FIG. 7, and FIG. 8 depict perspective views of a second embodiment 200 of a stackable building block, in accordance with embodiments of the present invention.

Figure 4:
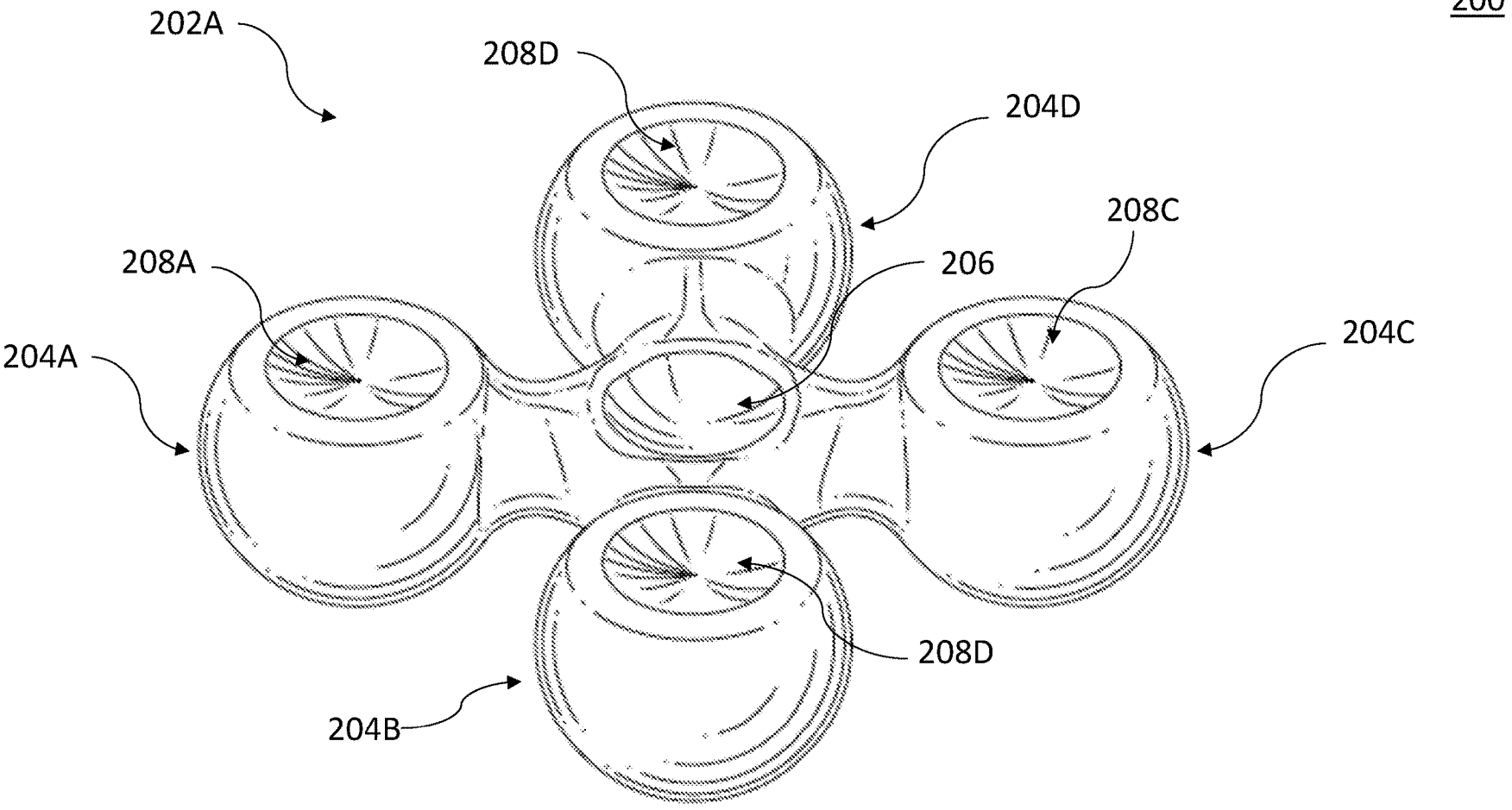
FIG. 4 depicts a three-quarters perspective view of a second embodiment of a stackable building block, in accordance with embodiments of the present invention.
Figure 5:
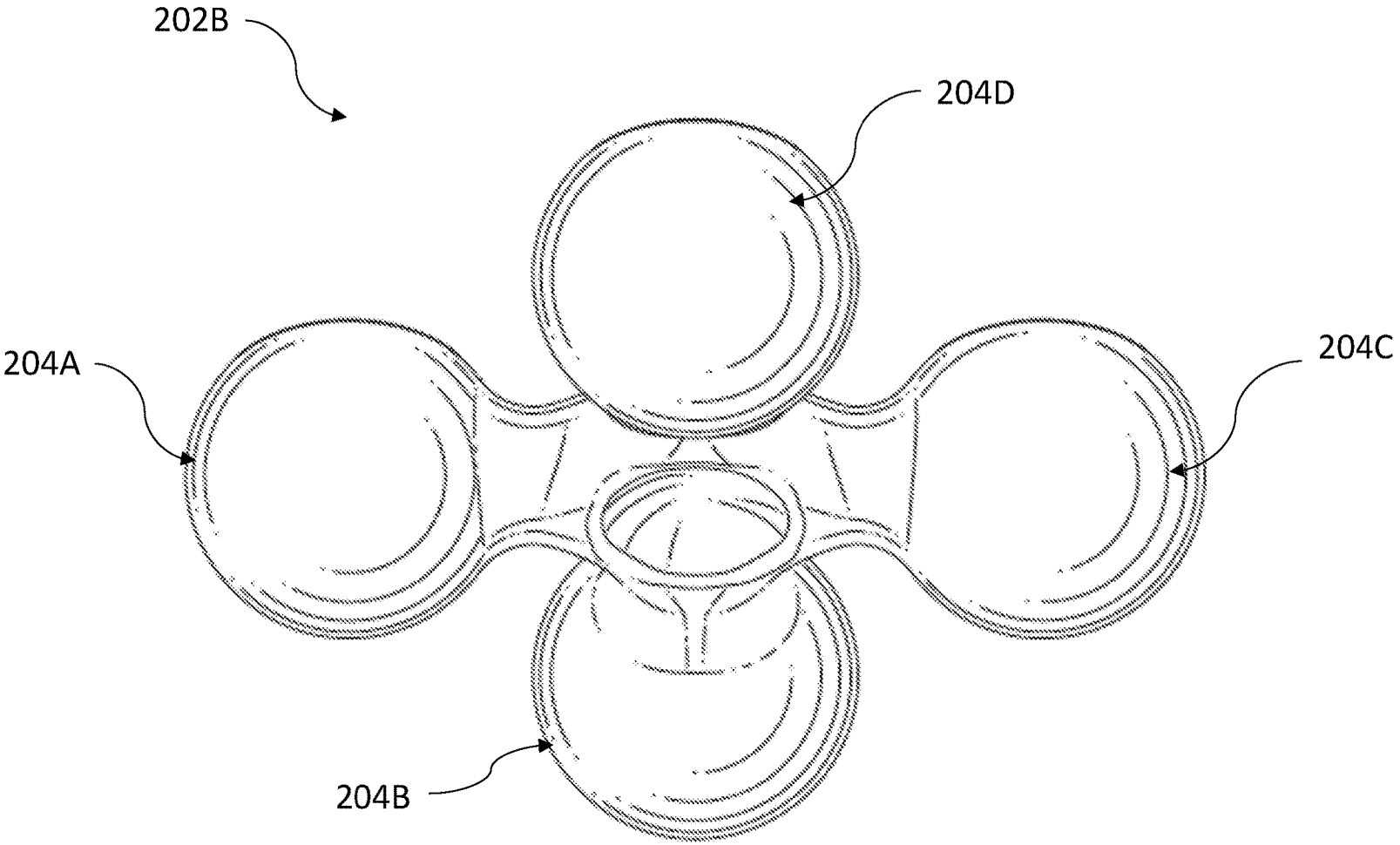
FIG. 5 depicts a bottom perspective view thereof of a second embodiment of a stackable building block, in accordance with embodiments of the present invention.
Figure 6:
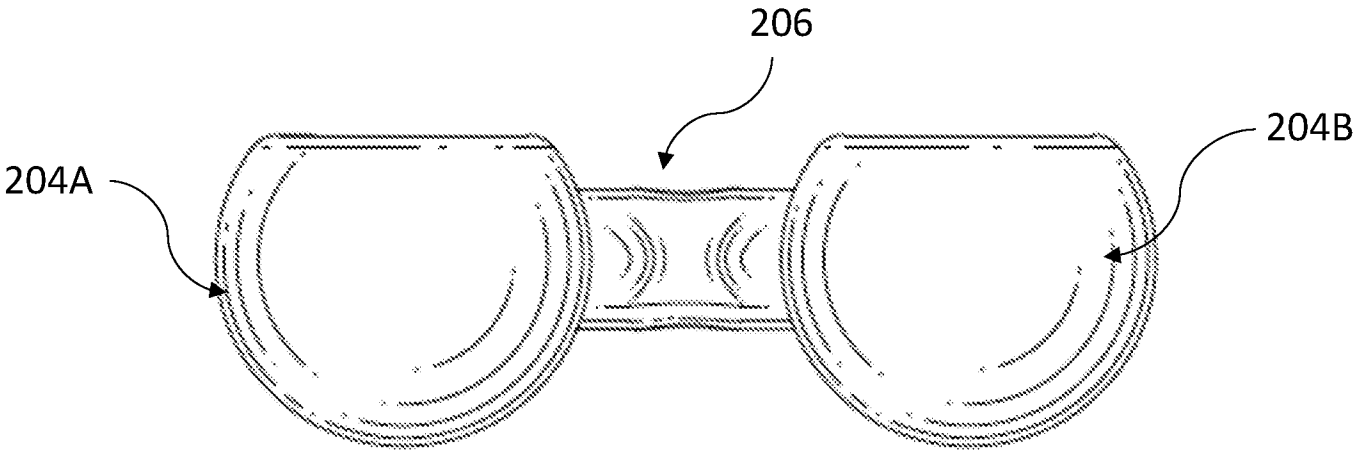
FIG. 6 depicts a side view thereof of a second embodiment of a stackable building block, in accordance with embodiments of the present invention.
Figure 7:
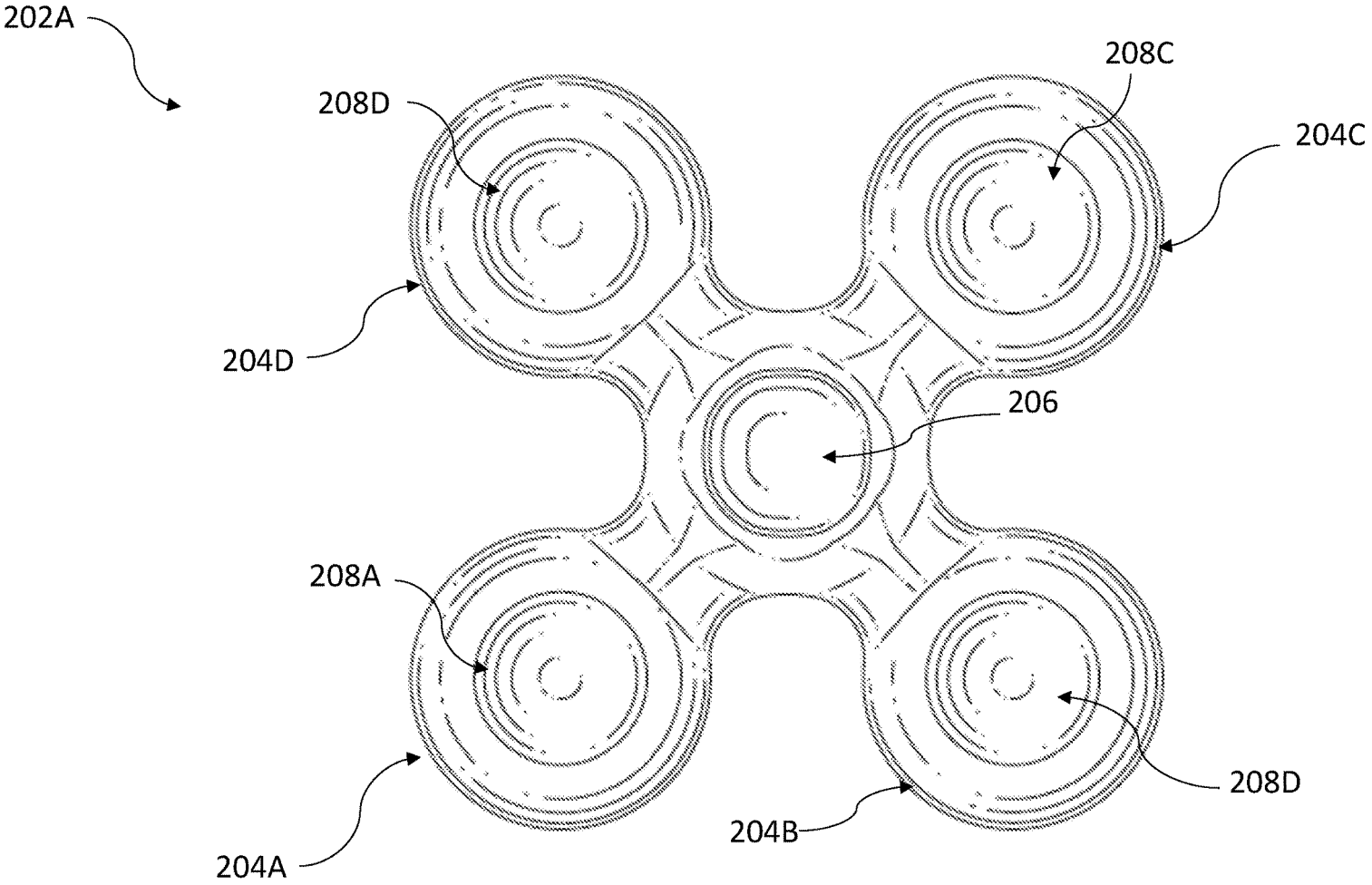
FIG. 7 depicts a top view thereof of a second embodiment of a stackable building block, in accordance with embodiments of the present invention.

The second embodiment 200 of the stackable building block comprises a sprocket configuration. In examples, the sprocket configuration is an X-shaped sprocket configuration, as depicted in FIG. 4, FIG. 5, FIG. 7, and FIG. 8. The X-shaped sprocket configuration has a first side 202A (of FIG. 4 and FIG. 7) disposed opposite a second side 202B (of FIG. 5 and FIG. 8). The X-shaped sprocket configuration comprises four radial spheres 204A, 204B, 204C, and 204D located equidistant from a center 206 (as depicted in FIG. 4, FIG. 6, and FIG. 7) of the X-shaped sprocket configuration.

The first side 202A of each of the four radial spheres 204A, 204B, 204C, and 204D comprises a concave portion 208A, 208B, 208C, and 208D, respectively. The concave portion 208A is associated with the radial sphere 204A, the concave portion 208B is associated with the radial sphere 204B, the concave portion 208C is associated with the radial sphere 204C, and the concave portion 208D is associated with the radial sphere 204D.

Figure 8:
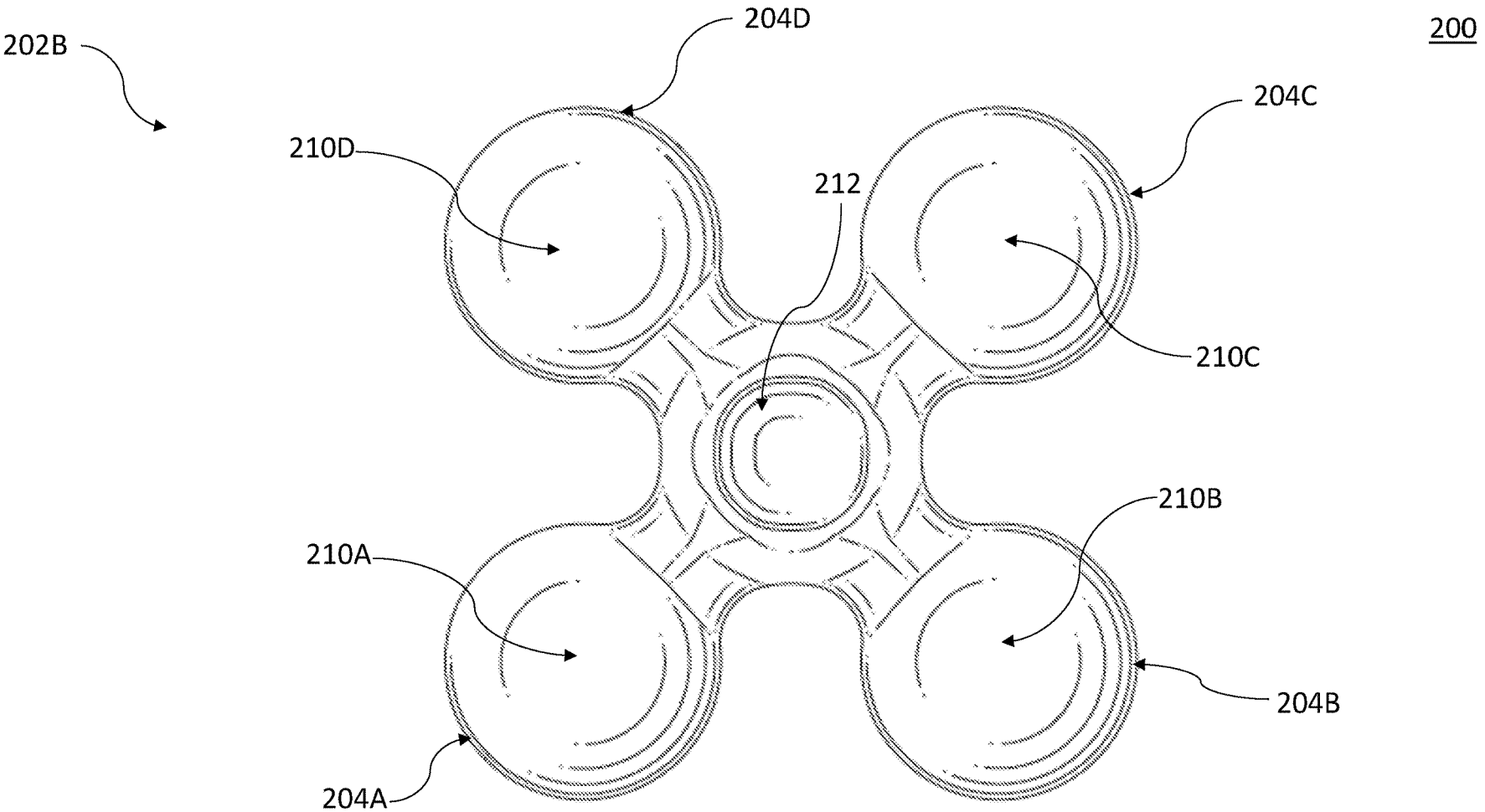
FIG. 8 depicts a bottom view thereof of a second embodiment of a stackable building block, in accordance with embodiments of the present invention.

The second side 202B of each of the four radial spheres 204A, 204B, 204C, and 204D comprises a convex portion 210A, 210B, 210C, and 210D (as depicted in FIG. 8), respectively. The convex portion 210A corresponds to the radial sphere 204A, the convex portion 210B corresponds to the radial sphere 204B, the convex portion 210C corresponds to the radial sphere 204C, and the convex portion 210D corresponds to the radial sphere 204D. Further, as depicted in FIG. 8, the second side 202B of a center of the X-shaped sprocket configuration comprises a concave portion 212. It should also be appreciated that the first side 202A of the center of the X-shaped sprocket configuration comprises a concave portion (not shown) corresponding to the concave portion 212.

Figure 9:
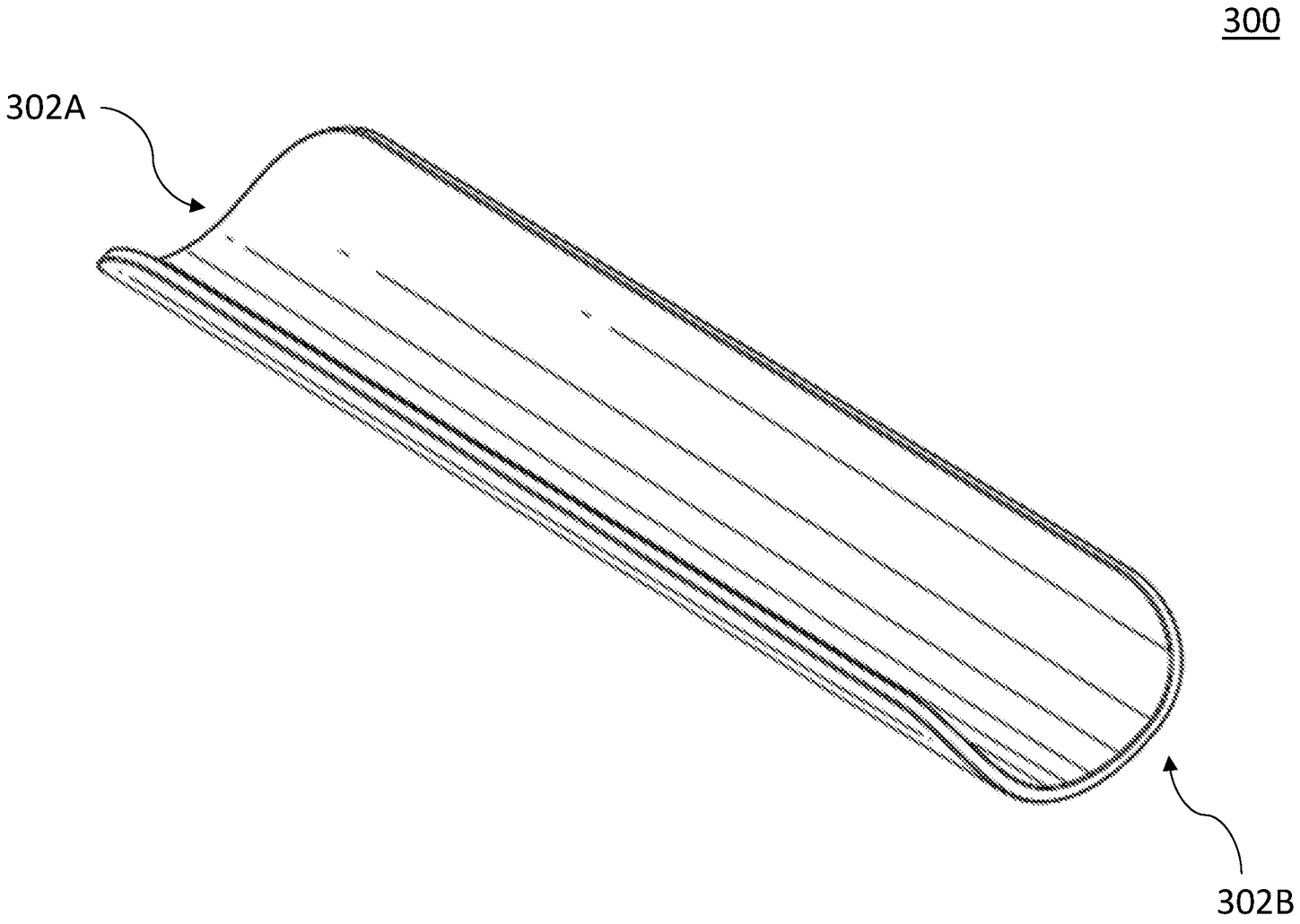
FIG. 9 depicts a three-quarters perspective view of a third embodiment of a stackable building block, in accordance with embodiments of the present invention.
Figure 10:
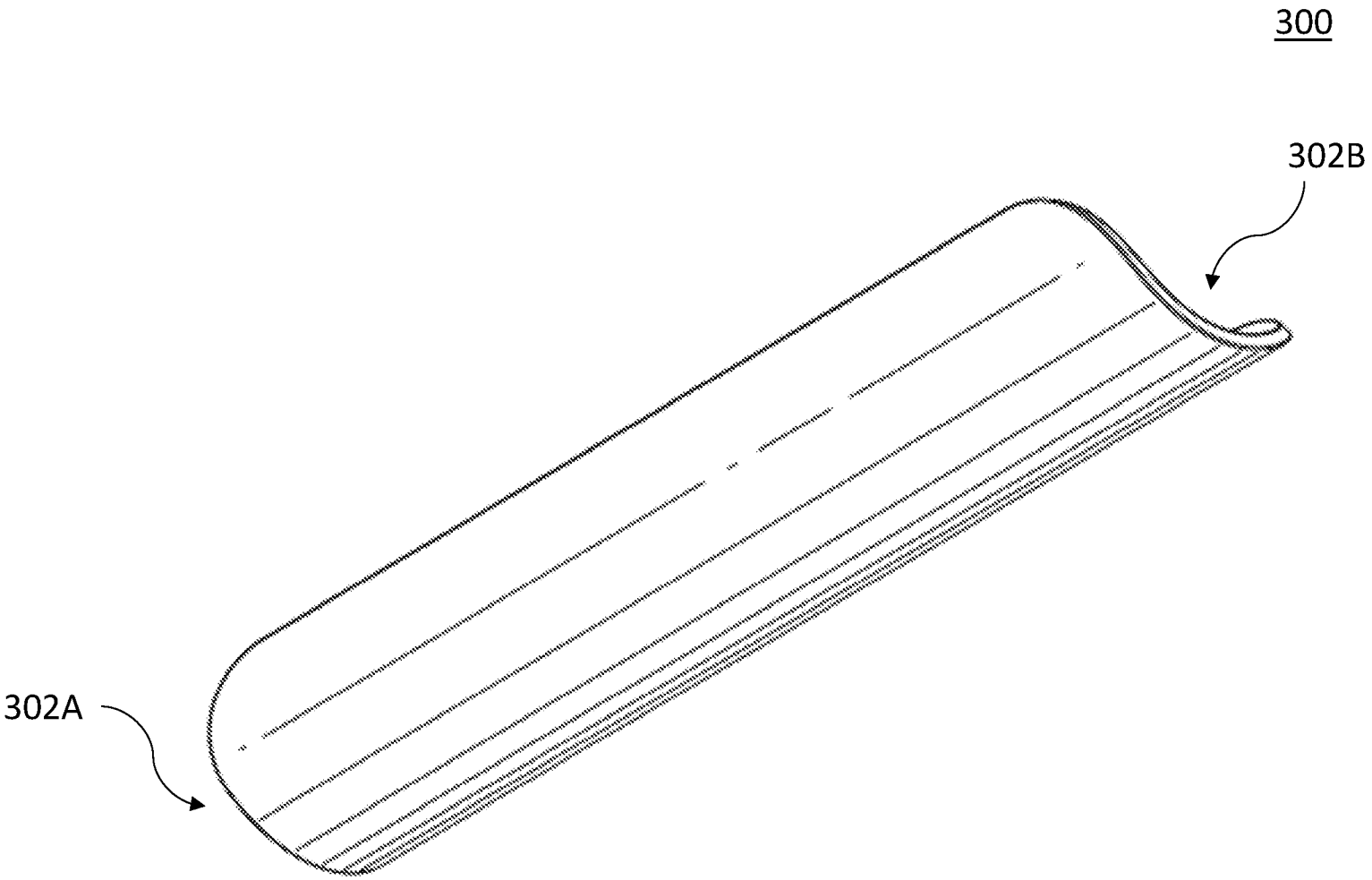
FIG. 10 depicts a bottom perspective view thereof of a third embodiment of a stackable building block, in accordance with embodiments of the present invention.
Figure 11:
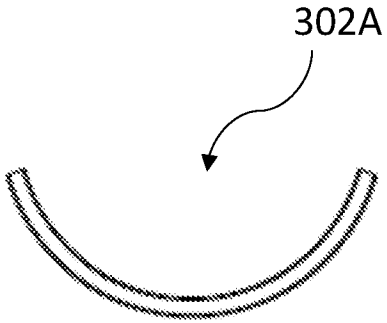
FIG. 11 depicts a front elevational view thereof of a third embodiment of a stackable building block, in accordance with embodiments of the present invention.

FIG. 9, FIG. 10, and FIG. 11 depict perspective views of a third embodiment 300 of a stackable building block, in accordance with embodiments of the present invention.

The third embodiment 300 of the stackable building block comprises a shape having a half-pipe configuration. As shown in FIG. 9, FIG. 10, and FIG. 11, the half-pipe configuration comprises rounded corners 302A, 302B disposed opposite one another.

FIG. 12, FIG. 13, FIG. 14, FIG. 15, and FIG. 16 depict perspective view of a fourth embodiment 400 of a stackable building block, in accordance with embodiments of the present invention.

Figure 12:
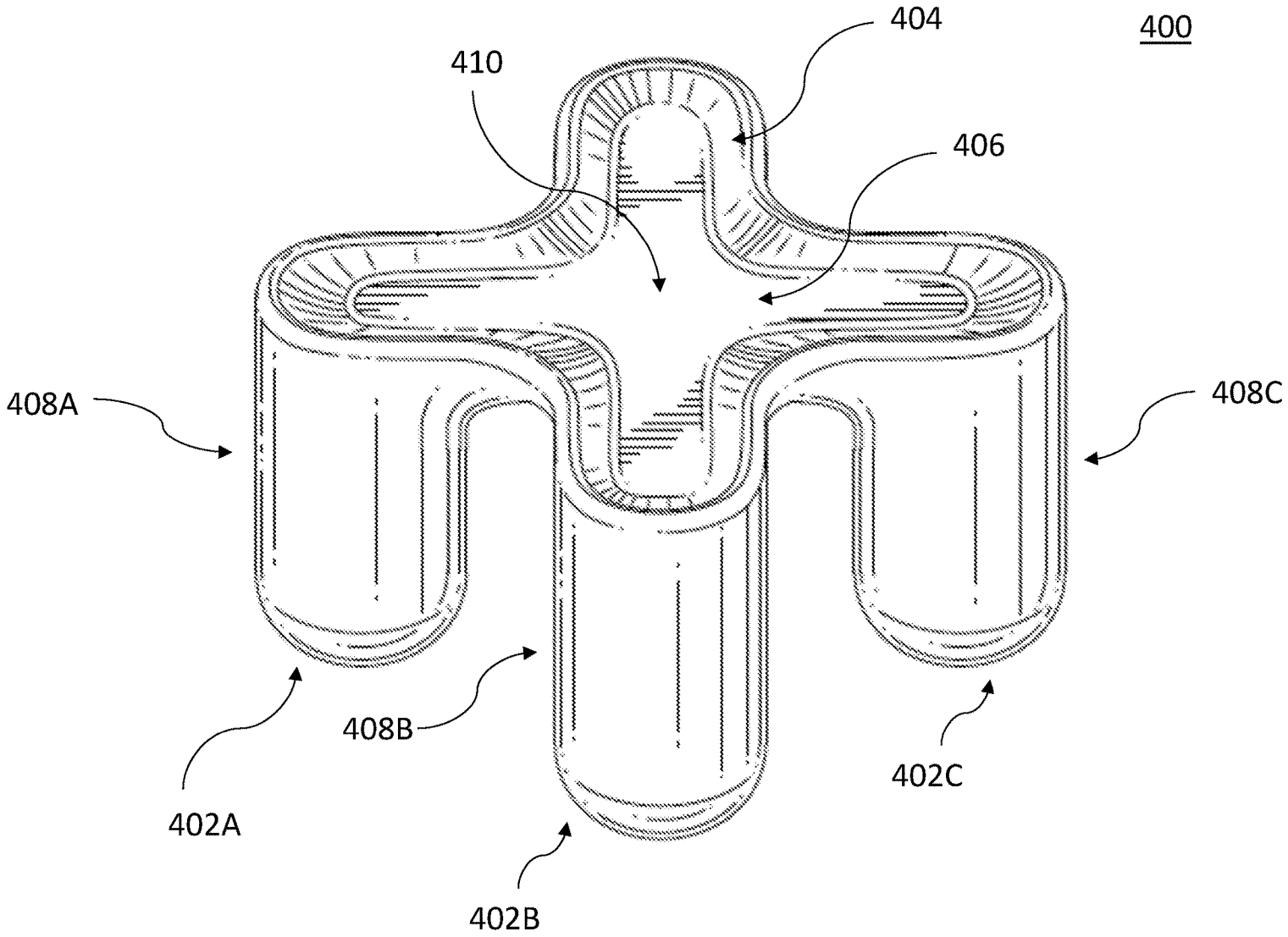
FIG. 12 depicts a three-quarters perspective view of a fourth embodiment of a stackable building block, in accordance with embodiments of the present invention.
Figure 14:
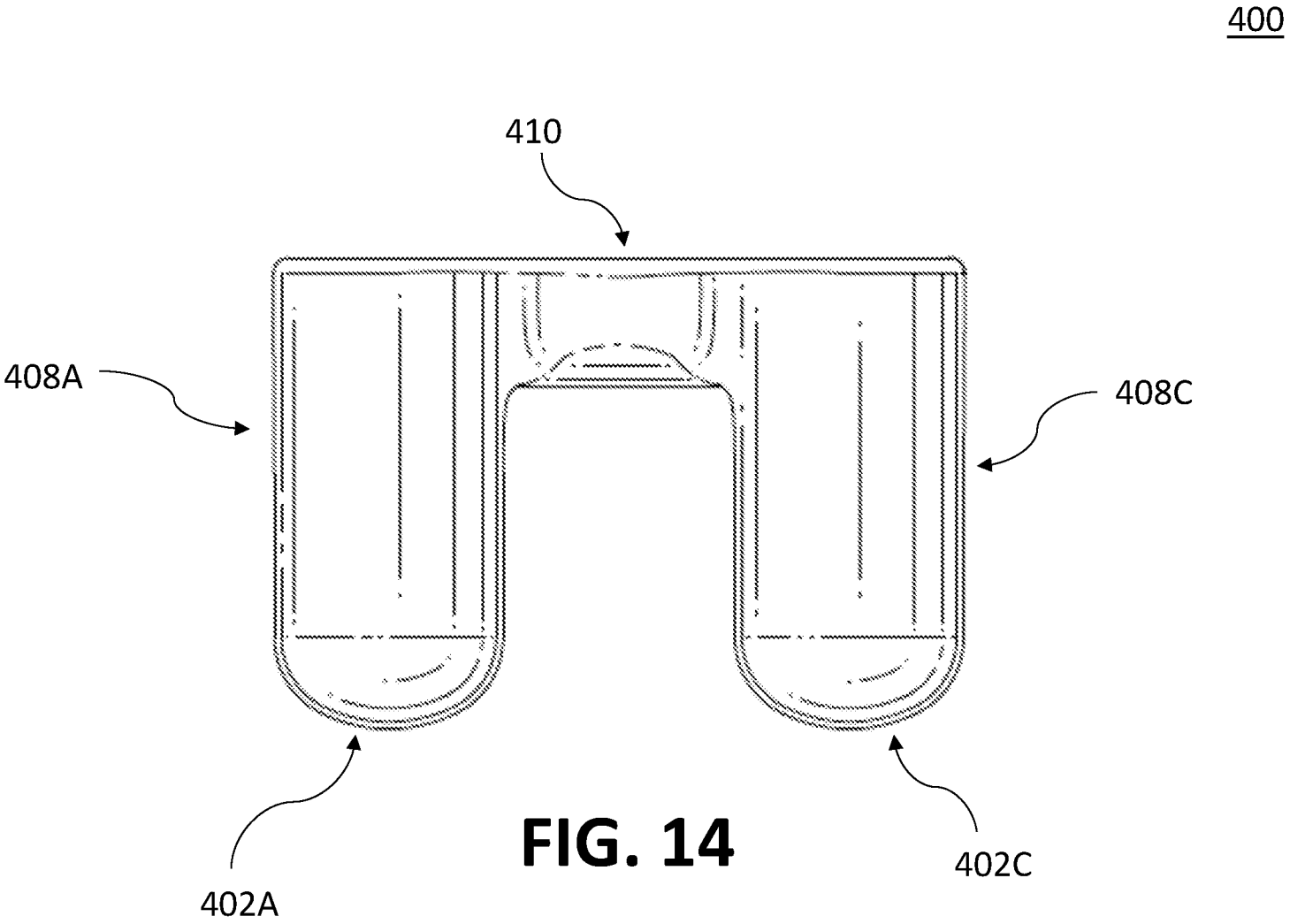
FIG. 14 depicts a side view thereof of a fourth embodiment of a stackable building block, in accordance with embodiments of the present invention.
Figure 15:
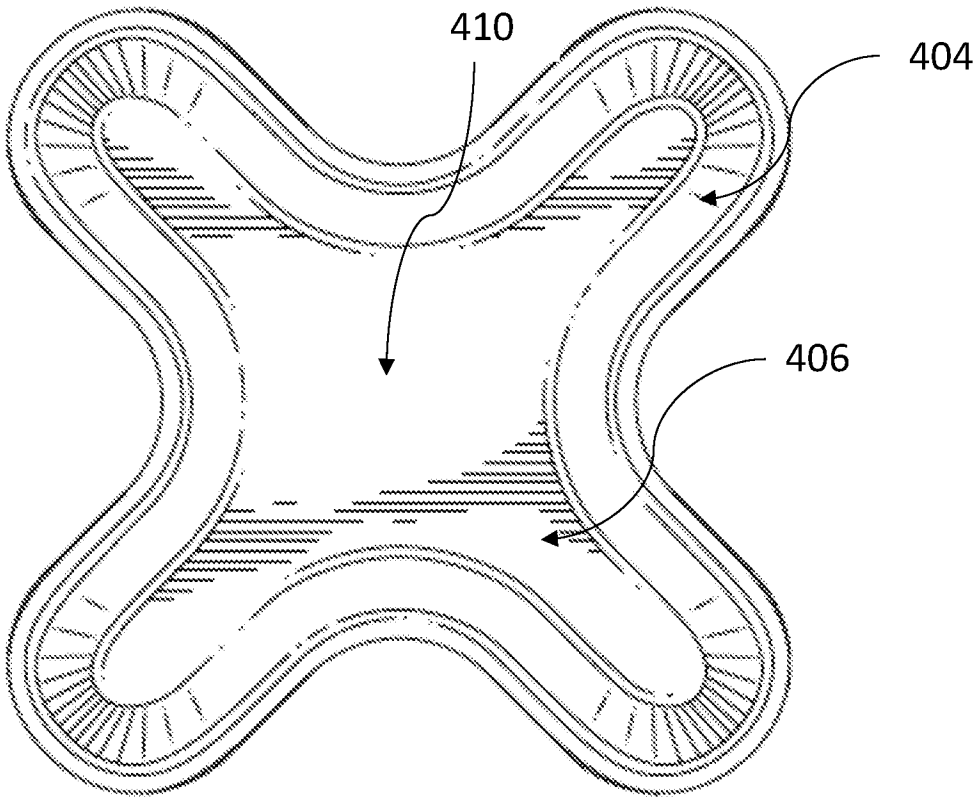
FIG. 15 depicts a top view thereof of a fourth embodiment of a stackable building block, in accordance with embodiments of the present invention.

The fourth embodiment 400 of the stackable building block comprises a shape having a table configuration. The table configuration is an X-shaped table configuration, as depicted in at least FIG. 12 and FIG. 13. This X-shaped table configuration comprises four legs 408A, 408B, 408C, and 408D, as depicted in at least FIG. 13. In examples, each of the four legs 408A, 408B, 408C, and 408D are cylindrical legs located equidistant from a center 410 (as depicted in FIG. 12, FIG. 14, and FIG. 15) of the X-shaped table configuration.

Figure 13:
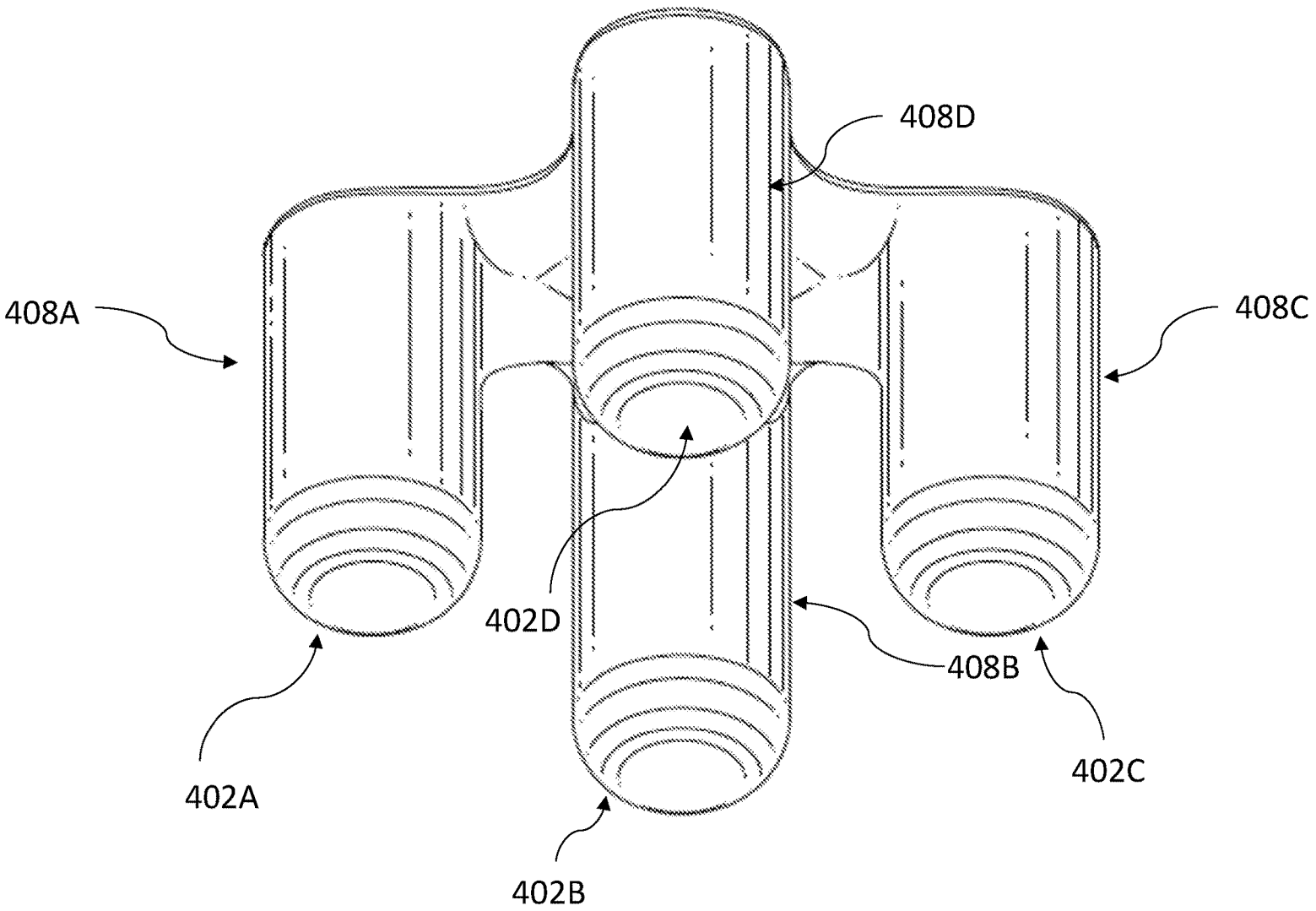
FIG. 13 depicts a bottom perspective view thereof of a fourth embodiment of a stackable building block, in accordance with embodiments of the present invention.
Figure 16:
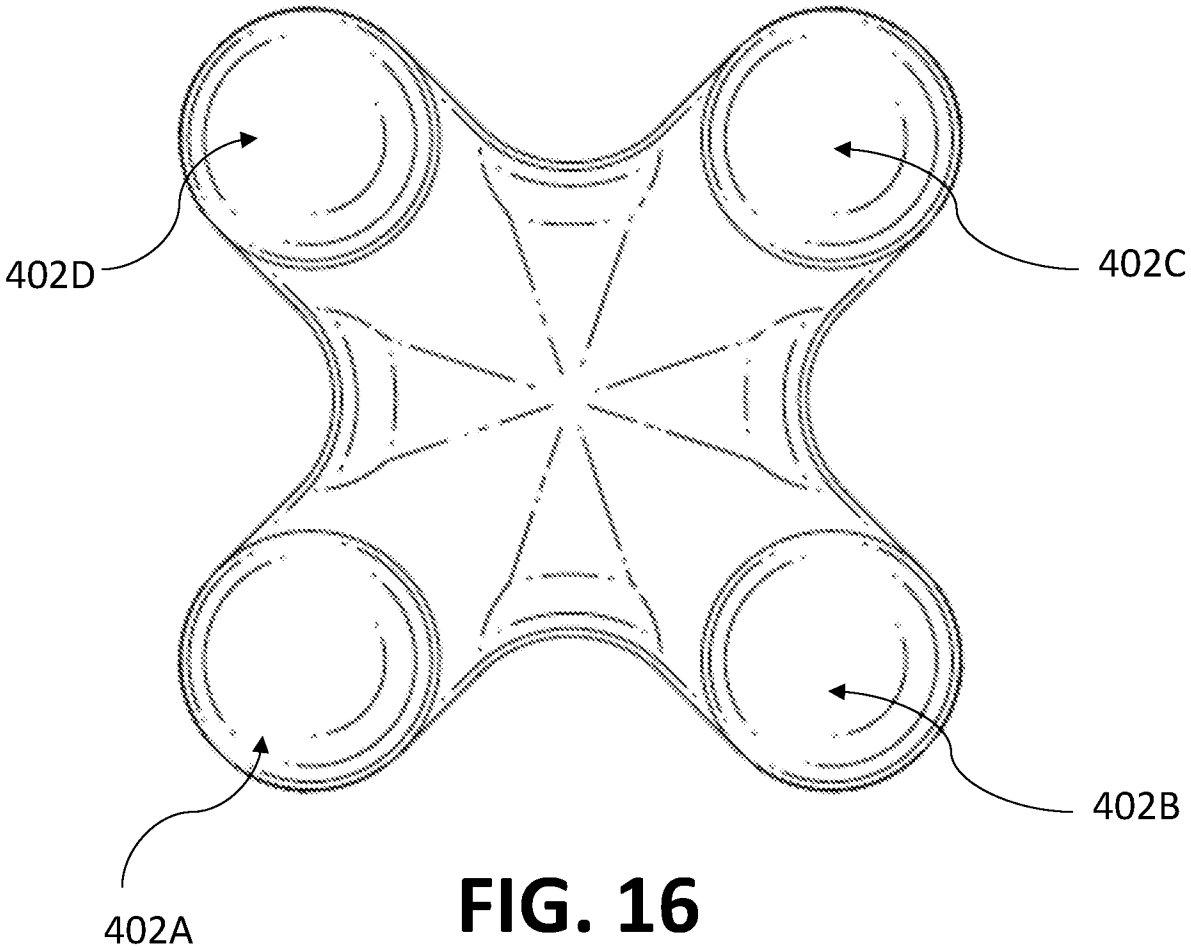
FIG. 16 depicts a bottom view thereof of a fourth embodiment of a stackable building block, in accordance with embodiments of the present invention.

As depicted in at least FIG. 13 and FIG. 16, each of the four legs 408A, 408B, 408C, and 408D comprises a convex foot 402A, 402B, 402C, and 402D, respectively. The convex foot 402A corresponds to the leg 408A, the convex foot 402B corresponds to the leg 408B, convex foot 402C corresponds to the leg 408C, and convex foot 402D corresponds to the leg 408D. As depicted in FIG. 12 and FIG. 15, the four legs 408A, 408B, 408C, and 408D form an arch 404 spanning a periphery of the X-shaped table configuration that forms a concave tabletop 406. The concave tabletop 406 is disposed opposite each of the convex feet 402A, 402B, 402C, and 402D.

A building block system comprising at least two stackable building blocks of the first embodiment 100, the second embodiment 200, the third embodiment 300, and/or the fourth embodiment 400 is contemplated. In other examples, the building block system comprises the first embodiment 100, the second embodiment 200, the third embodiment 300, and the fourth embodiment 400 of the stackable building blocks described infra in FIG. 1-FIG. 16. The unique shapes of each of the first embodiment 100, the second embodiment 200, the third embodiment 300, and the fourth embodiment 400 of the stackable building blocks allows the stackable building blocks to stack, interlock with one another, and sit securely in each other's shape. Moreover, the unique shapes of each of the first embodiment 100, the second embodiment 200, the third embodiment 300, and the fourth embodiment 400 of the stackable building blocks allows a child to build an infinite number of shapes and configurations outright.

It should be appreciated that any of the concave surfaces of the first embodiment 100, the second embodiment 200, the third embodiment 300, and/or the fourth embodiment 400 of the stackable building blocks may engage any of the convex surfaces of the first embodiment 100, the second embodiment 200, the third embodiment 300, and/or the fourth embodiment 400 of the stackable building blocks to interconnect a first stackable building block to a second stackable building block.

As an illustrative example, one or more of the convex surfaces 106B, 106C, and 106D of the first embodiment 100 of the stackable building block may engage one or more of the concave portions 208A, 208B, 208C, and 208D of the first side 202A of each of the four radial spheres 204A, 204B, 204C, and 204D, respectively, of the second embodiment 200 of the stackable building block to stack or connect the first embodiment 100 of the stackable building block to the second embodiment 200 of the stackable building block. In another illustrative example, the convex portions 210A, 210B, 210C, and 210D of each of the four radial spheres 204A, 204B, 204C, and 204D on the second side 202B of the second embodiment 200 of the stackable building blocks may engage the concave tabletop 406 of the fourth embodiment 400 of the stackable building block. It should be appreciated that limitless configurations and interconnections are contemplated between the first embodiment 100, the second embodiment 200, the third embodiment 300, and/or the fourth embodiment 400 of the stackable building blocks that are not explicitly listed herein.

In examples, the building block system is a learning-based building block system that may be used for teaching, engaging a child's brain, play-based learning, improving a child's gross motor skills, improving a child's fine motor skills, teaching a child about physics in a tangible and kinesthetic way, and/or outdoor or playground landscaping.

In some examples, each of the first embodiment 100, the second embodiment 200, the third embodiment 300, and/or the fourth embodiment 400 of the stackable building blocks is a large, outdoor learning based building block. In this example, the building block system may be used outside (e.g., on a playground or a school yard). In another example, each of the first embodiment 100, the second embodiment 200, the third embodiment 300, and/or the fourth embodiment 400 of the stackable building blocks is smaller in size, allowing a child to play with each of the first embodiment 100, the second embodiment 200, the third embodiment 300, and/or the fourth embodiment 400 of the stackable building blocks inside and on a table top setting. In this example, the child may engage with the stackable building blocks inside of a classroom, a library, or a house.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A building block system comprising:

at least a first block having an X-shaped sprocket configuration and a second block having an X-shaped table configuration, the X-shaped sprocket configuration comprising a first side disposed opposite a second side and four radial spheres located equidistant from a center of the X-shaped sprocket configuration, wherein the first side of each of the four radial spheres of the X-shaped sprocket configuration comprises a convex portion, wherein the second side of each of the four radial spheres of the X-shaped sprocket configuration comprises a concave portion, and wherein the second side of the center of the X-shaped sprocket configuration comprises a concave portion, and the X-shaped table configuration comprising four cylindrical legs located equidistant from a center of the X-shaped table configuration, wherein each of the four cylindrical legs of the X-shaped table configuration comprises a convex foot, wherein the four cylindrical legs of the X-shaped table configuration form an arch spanning a periphery of the X-shaped table configuration such that the arch forms a concave tabletop disposed opposite each of the convex feet, and wherein the convex feet of the four cylindrical legs of the X-shaped table configuration are received by the concave portion of second side of each of the four radial spheres of the X-shaped sprocket configuration in a ball-in-socket configuration.

2. The building block system of claim 1, further comprising:

a third block having a third shape, wherein the third shape comprises a half-pipe configuration.

3. The building block system of claim 2, wherein the half-pipe configuration comprises rounded corners.

4. A learning-based building block system comprising:

a first block having a cube configuration, wherein the cube configuration of the first block is a concavely-rounded cube configuration comprising:

six sides of equal dimension;

eight circular corners of equal dimension projecting radially from a center of the concavely-rounded cube configuration;

convex surfaces; and concave surfaces, wherein the convex surfaces match the concave surfaces via a ball-in-socket configuration;

a second building block comprising an X-shaped sprocket configuration, the X-shaped sprocket configuration comprising:

a first side disposed opposite a second side; and four radial spheres located equidistant from a center of the X-shaped sprocket configuration, wherein the first side of each of the four radial spheres comprises a convex portion, wherein the second side of each of the four radial spheres comprises a concave portion, and wherein the second side of the center of the X-shaped sprocket configuration comprises the concave portion;

a third building block having a half-pipe configuration; and a fourth building block comprising an X-shaped having a table configuration, the X-shaped table configuration comprising: four cylindrical legs located equidistant from a center of the X-shaped table configuration, wherein each of the four cylindrical legs comprises a convex foot, wherein the four cylindrical legs form an arch spanning a periphery of the X-shaped table configuration such that the arch forms a concave tabletop disposed opposite each of the convex feet, and wherein the convex feet of the four cylindrical legs of the X-shaped table configuration are received by the concave portion of second side of each of the four radial spheres of the X-shaped sprocket configuration in a ball-in-socket configuration.

5. The learning-based building block system of claim 4, wherein the half-pipe configuration of the third building block comprises rounded corners.

* * * * *